US010597799B2

(12) United States Patent
D'Agnolo et al.

(10) Patent No.: US 10,597,799 B2
(45) Date of Patent: Mar. 24, 2020

(54) AIR-JET TYPE SPINNING DEVICE

(71) Applicant: SAVIO MACCHINE TESSILI S.p.A., Pordenone (IT)

(72) Inventors: Fabio D'Agnolo, Pordenone (IT); Vittorio Colussi, Pordenone (IT)

(73) Assignee: SAVIO MACCHINE TESSILI S.P.A. (IT)

( * ) Notice: Subject to any disclaimer, the term of this patent is extended or adjusted under 35 U.S.C. 154(b) by 202 days.

(21) Appl. No.: 15/582,094

(22) Filed: Apr. 28, 2017

(65) Prior Publication Data

US 2017/0314166 A1 Nov. 2, 2017

(30) Foreign Application Priority Data

Apr. 29, 2016 (IT) ..... 102016000044012

(51) Int. Cl.
*D01H 4/02* (2006.01)
*D01H 1/10* (2006.01)
(Continued)

(52) U.S. Cl.
CPC ..... *D01H 4/02* (2013.01); *D01H 1/10* (2013.01); *D01H 1/105* (2013.01); *D01H 1/11* (2013.01);
(Continued)

(58) Field of Classification Search
CPC .. D01H 4/02; D01H 4/30; D01H 4/34; D01H 4/38; D01H 1/10; D01H 1/105;
(Continued)

(56) References Cited

U.S. PATENT DOCUMENTS 3,722,198 A 3/1973 Gotzfried
4,457,130 A * 7/1984 Sakai ..... D01H 1/115 57/328
(Continued)

FOREIGN PATENT DOCUMENTS

CN 103 603 094 2/2014
DE 10 2012 101001 8/2013
(Continued)

OTHER PUBLICATIONS

EP0418693A1 Translation (Year: 2019).*
(Continued)

*Primary Examiner* — Alissa J Tompkins
*Assistant Examiner* — Dakota Marin
(74) *Attorney, Agent, or Firm* — Valauskas Corder LLC

(57) ABSTRACT

An air-jet type spinning device (4), comprising a body (8) at least partially hollow which defines a spinning chamber (12), a fibre feed device (16), facing said spinning chamber (12) so as to feed the fibres into the spinning chamber (12), a spinning spindle (20) at least partially inserted in the spinning chamber (12) and fitted with a spinning channel (24) for the suction of yarn obtained from said fibres, the spinning channel (24) defining a spinning direction (X-X), at least one channel (28) for sending a jet of compressed air inside the spinning chamber (12). Advantageously, the spinning chamber (12) is delimited at least partially by an outer side wall (32), opposite the spinning spindle (20), wherein at least one thread (36) is made on said outer side wall (32), wherein said at least one channel (28) is oriented so as to direct the jet of compressed air towards the at least one thread (36) in order to be guided and oriented by the latter.

19 Claims, 4 Drawing Sheets

(51) Int. Cl.

| | |
|---|---|
| ***D01H 1/11*** | (2006.01) |
| ***D01H 4/34*** | (2006.01) |
| ***D02G 1/16*** | (2006.01) |
| ***D01H 4/38*** | (2006.01) |
| ***D01H 1/24*** | (2006.01) |
| ***D01H 4/30*** | (2006.01) |
| ***D01H 1/115*** | (2006.01) |

(52) U.S. Cl.
CPC ..... *D01H 1/115* (2013.01); *D01H 1/24* (2013.01); *D01H 4/30* (2013.01); *D01H 4/34* (2013.01); *D01H 4/38* (2013.01); *D02G 1/16* (2013.01); *D02G 1/161* (2013.01); *D02G 1/162* (2013.01); *D02G 1/164* (2013.01); *D02G 1/165* (2013.01); *D02G 1/167* (2013.01); *D02G 1/168* (2013.01)

(58) Field of Classification Search
CPC . D01H 1/11; D01H 1/115; D01H 1/24; D02G 1/16; D02G 1/161; D02G 1/162; D02G 1/164; D02G 1/165; D02G 1/167; D02G 1/168
USPC ..... 57/350
See application file for complete search history.

(56) References Cited

U.S. PATENT DOCUMENTS

| | | | | | |
|---|---|---|---|---|---|
| 4,807,431 | A * | 2/1989 | Braxmeier | D01H 1/115 | 28/271 |
| 5,169,071 | A * | 12/1992 | Boger | B05B 7/0861 | 239/296 |
| 5,193,335 | A * | 3/1993 | Mori | D01H 1/115 | 57/296 |
| 5,295,349 | A * | 3/1994 | Okamoto | D01H 4/02 | 57/328 |
| 5,419,110 | A * | 5/1995 | Mikami | D01H 1/115 | 57/261 |
| 5,528,895 | A * | 6/1996 | Deno | D01H 1/115 | 57/315 |
| 6,789,382 | B2 * | 9/2004 | Stalder | D01H 1/115 | 57/328 |
| 2004/0025488 | A1 * | 2/2004 | Anderegg | D01H 1/115 | 57/400 |
| 2014/0116022 | A1 * | 5/2014 | Kubler | D01H 4/02 | 57/350 |

FOREIGN PATENT DOCUMENTS

| | | | | |
|---|---|---|---|---|
| EP | 0418693 | A1 * | 3/1991 | D01H 1/115 |
| EP | 2009150 | | 12/2008 | |
| EP | 2 677 070 | | 12/2013 | |
| EP | 2677070 | A1 * | 12/2013 | D01H 1/115 |
| EP | 2009150 | B2 * | 1/2018 | |
| JP | 61186531 | A * | 8/1986 | D01H 1/115 |
| JP | S61186531 | | 8/1986 | |

OTHER PUBLICATIONS

JPS61186531 English Translation (Year: 2019).*
Italian Search Report, dated Sep. 23, 2016.
European Search Report, dated Sep. 22, 2017.

* cited by examiner

AIR-JET TYPE SPINNING DEVICE

CROSS-REFERENCE TO RELATED APPLICATIONS

The present invention claims priority to Italian Patent Application No. 102016000044012 filed on Apr. 29, 2016.

FIELD OF APPLICATION

The present invention relates to an air-jet type spinning device.

STATE OF THE ART

As is known, air-jet type spinning devices perform yarn production starting from a fibre sliver.

Said sliver is subjected to the action of jets of compressed air (air-jet) which enable the outermost fibres to open up and wrap themselves around the central fibres, forming the yarn.

The solutions of the prior art have a number of drawbacks and limitations.

In fact, there are 4 or more holes for the injection of compressed air which require significant air consumption with an increase of energy consumption and therefore higher production costs of the yarn.

In addition, the known solutions, in order to obtain good quality yarns and limit the consumption of compressed air, require the creation of small spinning chambers. This way however, the chambers are extremely sensitive to the presence of dirt and fibrils which compromise the quality, repeatability and strength of the yarn.

In addition, the prior solutions entail some structural constraints in the realization of the spinning chamber since the jets of compressed air must be directed in an extremely accurate manner in the proximity of the tip of the spinning spindle: in other words the jets must be directed in a tangential direction and tilted downwards to obtain the necessary compressed air whirling motion which must, on the one hand, wind the outermost fibres around the innermost ones and on the other create the necessary vacuum for the suction of the fibres inside the spinning spindle. Despite such geometric constraints the prior solutions do not always guarantee control of the direction of the jets of compressed air inside the spinning chamber since the air, once it has left the nozzles, is not guided in its feed movement but propagates freely inside the spinning chamber. For this reason the air is more prone to deviations both due to the presence of impurities, such as fibrils and dirt, and to the presence of turbulence and vorticity.

This variability in the operating conditions of the spinning, as seen, contributes to scarce repeatability of the yarn quality produced.

In conclusion, the air-jet devices of the prior art entail a significant consumption of compressed air, high production costs and do not always guarantee the constancy and repeatability of obtaining a high quality, strong yarn.

PRESENTATION OF THE INVENTION

The need is therefore felt to solve the drawbacks and limitations mentioned with reference to the prior art.

Such need is satisfied by an air-jet spinning device according to claim 1.

DESCRIPTION OF THE DRAWINGS

Further characteristics and advantages of the present invention will be more clearly comprehensible from the description given below of its preferred and non-limiting embodiments, wherein.

The elements or parts of elements common to the embodiments described below will be indicated using the same reference numerals.

DETAILED DESCRIPTION

Figure 1:
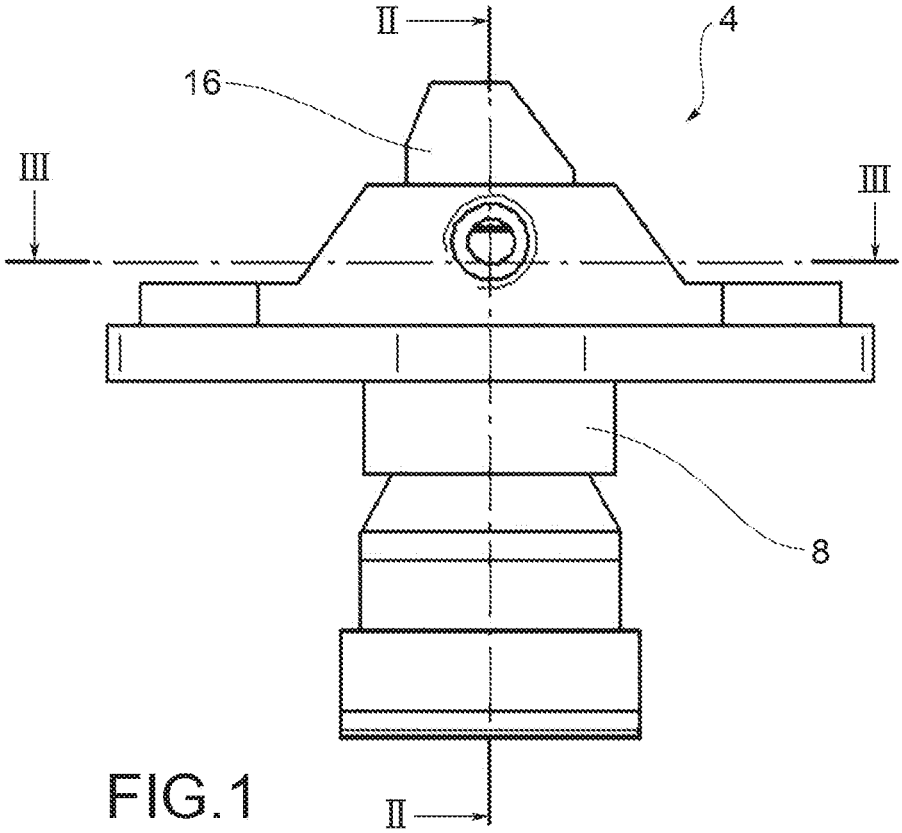
FIG. 1 shows a perspective view of an air-jet type spinning device according to an embodiment of the present invention.
Figure 2:
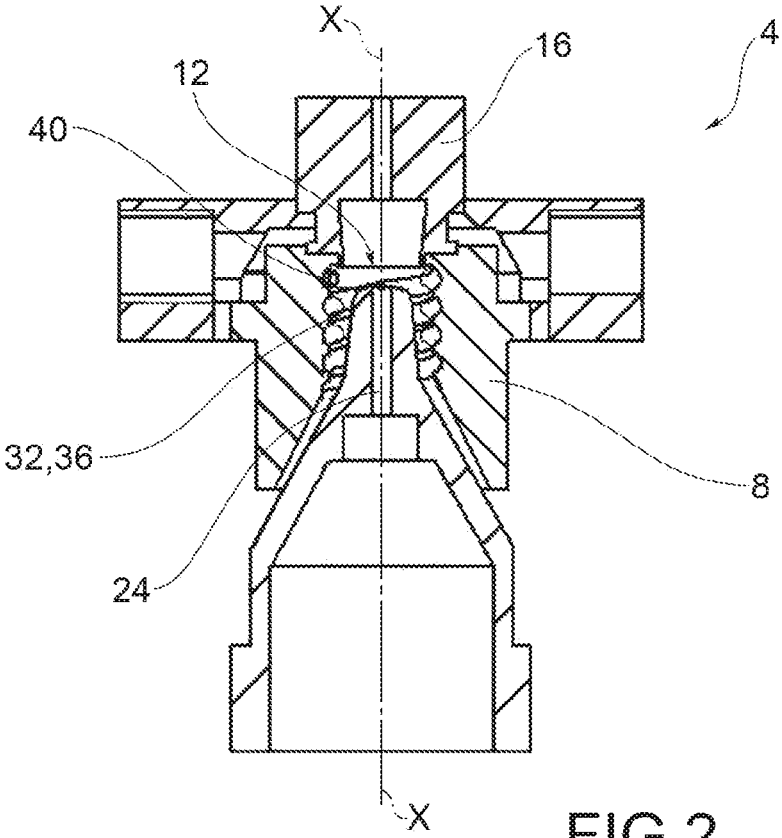
FIG. 2 shows a cross-section view of the air-jet type spinning device in FIG. 1, along the cross-section plane II-II in FIG. 1.
Figure 3:
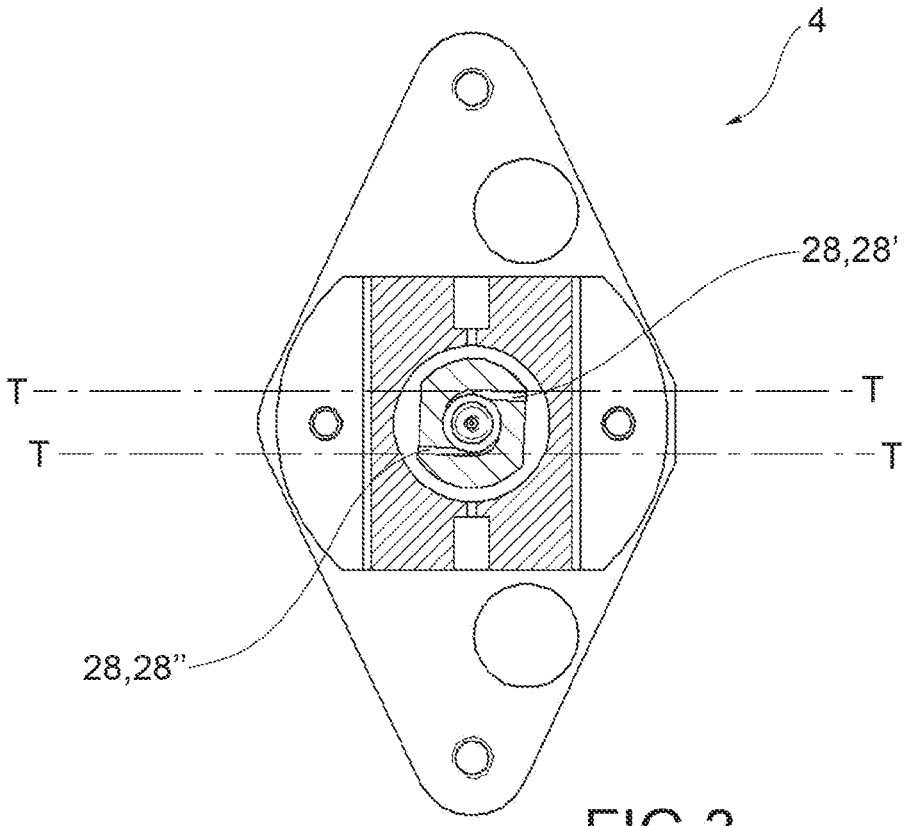
FIG. 3 shows a cross-section view of the air-jet type spinning device in FIG. 1, along the cross-section plane III-III in FIG. 1.
Figure 4:
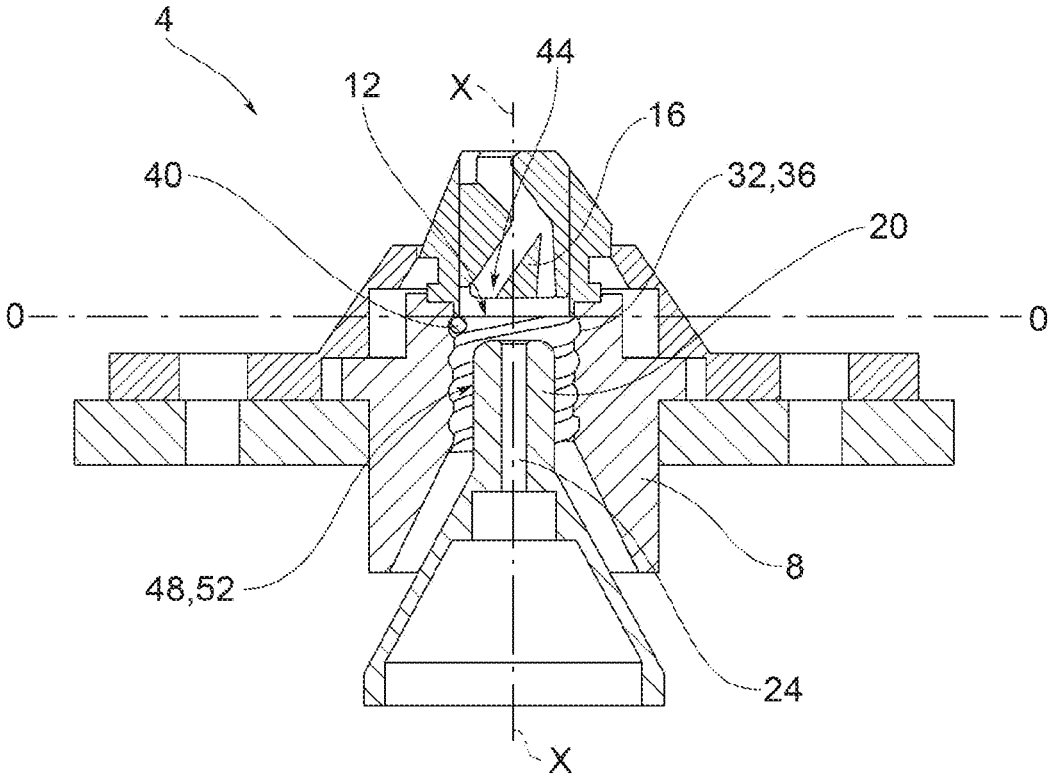
FIGS. 4-5 shows planar and perspective cross-section views of an air-jet type spinning device according to a further embodiment of the present invention.
Figure 5:
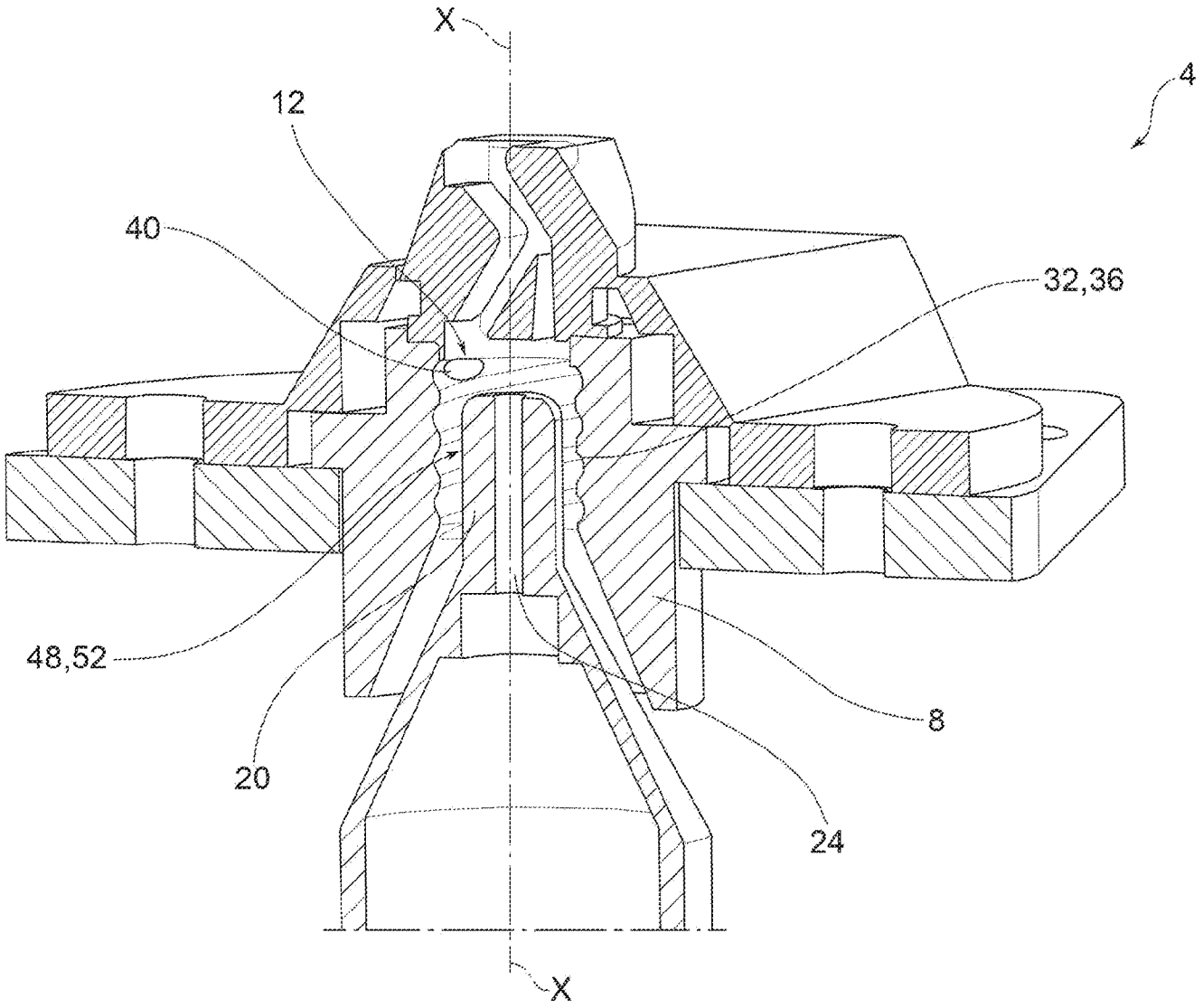
Figure 6:
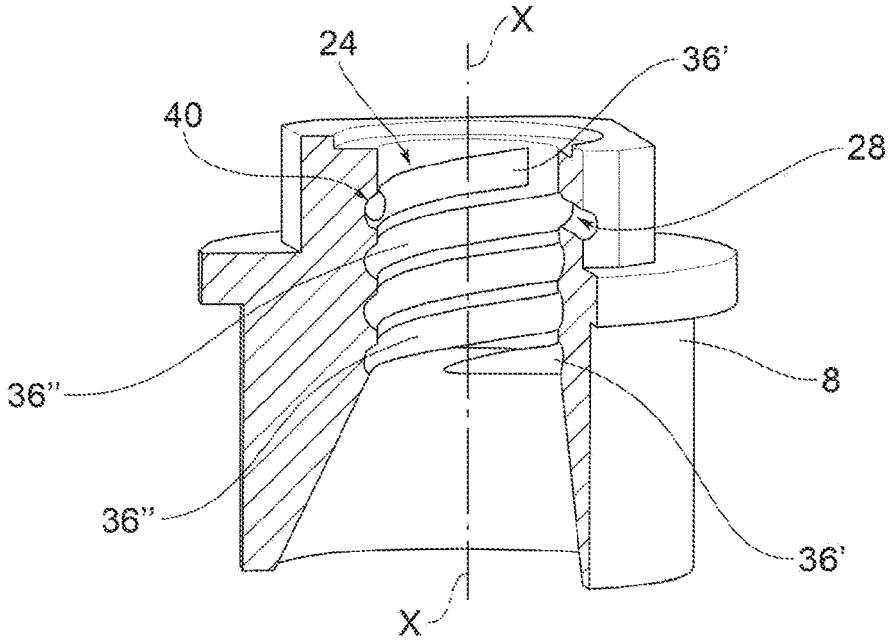
FIG. 6 shows a perspective view, in partial cross-section, of a body of an air-jet type spinning device according to an embodiment of the present invention.
Figure 7:
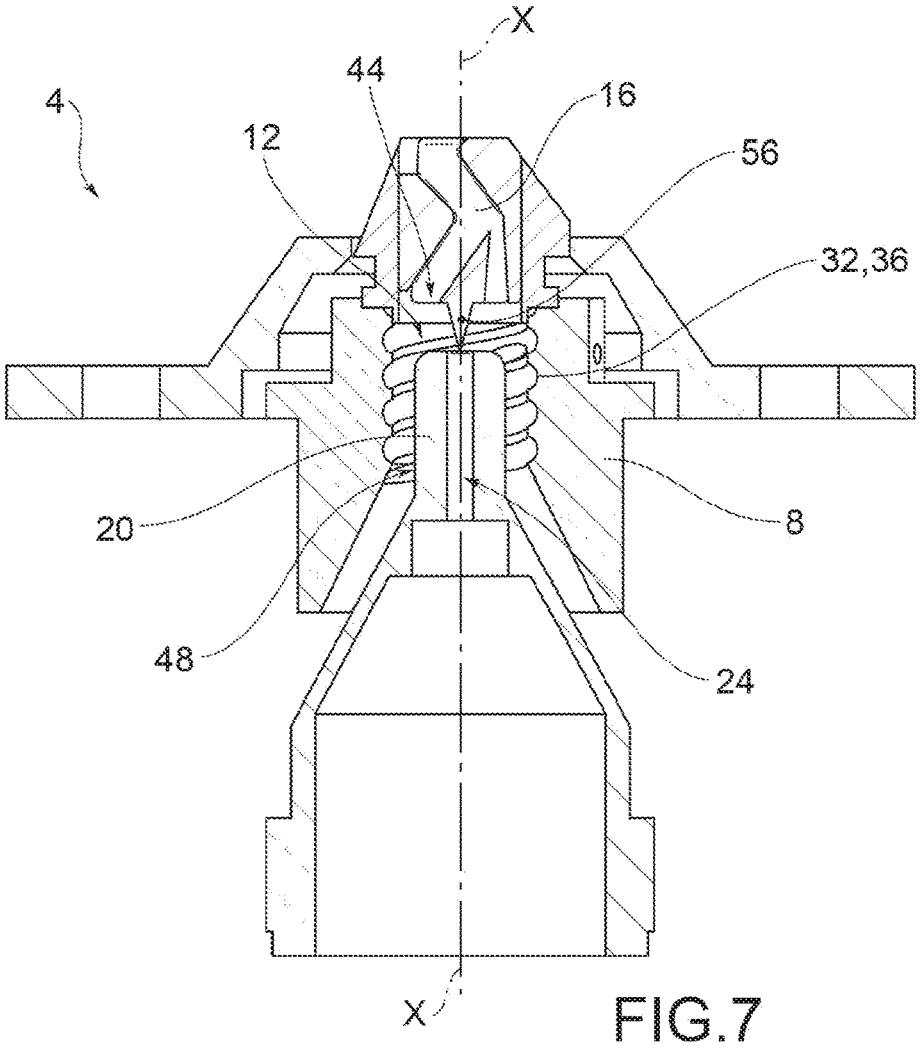
FIG. 7 shows a cross-section view of an air-jet type spinning device according to a further embodiment of the present invention.

With reference to the aforementioned figures, reference numeral 4 globally denotes an air-jet type spinning device comprising an at least partially hollow body 8 which delimits a spinning chamber 12, and a fibre feed device 16, facing said spinning chamber 12 so as to feed the fibre to the spinning chamber 12.

The spinning device 4 further comprises a spinning spindle 20 at least partially inserted in the spinning chamber 12 and fitted with a spinning channel 24 for the passage of yarn obtained from said fibres. The spinning channel 24 defines a spinning direction X-X.

The spinning device 4 further comprises at least one channel 28 for sending a jet of compressed air to the spinning chamber 12.

Advantageously, the spinning chamber 12 is delimited at least partially by an outer side wall 32, opposite the spinning spindle 20, wherein at least one thread 36 is made on said outer side wall 32, the at least one channel 28 is oriented so as to direct the jet of compressed air towards the at least one thread 36 in order to be guided and oriented by the latter. In other words, the nozzle is oriented to direct the jet of compressed air towards the thread 36 so that the compressed air, thanks to the Coandă effect, remains substantially adhered to the thread 36 and lets itself be guided by the latter, moving along the thread inside the spinning chamber 12.

According to one embodiment, the at least one thread 36 is a spiral thread, coaxial with said spinning channel 24 and parallel to the spinning direction X-X.

This way the compressed air moves according to a spiral motion inside the spinning chamber 12.

According to one embodiment, the outer side wall 32 of the spinning chamber 12 comprises two spiral threads 36', 36" coaxial and staggered with each other by 180°, and the spinning device 4 comprises at least two channels 28', 28", each sending a jet of compressed air to one of said spiral threads 36', 36".

Preferably, the outer side wall 32 of the spinning chamber 12 comprises a plurality of spiral threads 36, and the spinning device 4 comprises at least one channel 28 which sends a jet of compressed air to a corresponding spiral thread 36.

According to one embodiment, the spinning device 4 comprises at least two channels 28 which send compressed air to respective distinct threads 36 and which are staggered with each other with respect to the spinning direction X-X.

It is also possible to provide a spinning device 4 comprising at least two channels 28 which direct compressed air into two distinct emission points 40 of the same spiral thread 36.

According to a possible embodiment, the channels 28 are directed in a tangential direction T with respect to an emission point 40 in the respective spiral threads 36.

This condition of tangency facilitates the adhesion of the jet of compressed air to the thread 36 thanks to the Coandă effect and thus facilitates the proper targeting of the compressed air inside the spinning chamber 12.

According to one embodiment, at least one channel 28 is directed parallel to a horizontal surface O-O, perpendicular to said spinning direction X-X. Even in the condition of the jet of compressed air in the emission point 40 being horizontal, thanks to the presence of the spiral thread 36, the air can deviate downwards, i.e. towards the spinning spindle 20 following the geometry of said thread 36. There is therefore no need to direct the jets downward as in the solutions of the prior art.

In any case, it is also possible to provide at least one channel 28 tilted at a sharp angle with respect to a horizontal plane (O-O), perpendicular to said spinning direction X-X, in a direction moving towards the spinning spindle 20.

According to one embodiment, the channels 28 are positioned so as to send the relative jets of compressed air to an emission point 40 located downstream of a feed hole 44 of the fibres to the spinning chamber 12, relative to the spinning direction X-X. The feed hole 44 is the opening with which the fibre feed device 16 opens onto the spinning chamber 12.

The threads 36 may have various geometries; preferably they have a curved or semicircular cross-section geometry with a radius ranging between 0.25 mm and 2 mm.

Preferably, said threads 36 are tilted at a helix angle of 5° to 15°.

Preferably, the pitch of said 36 threads is between 1.5 mm and 4 mm.

It is possible to use both fixed pitch threads 36 and variable pitch threads; in addition it is also possible to use both fixed helix angle threads and variable helix angle threads.

The spinning chamber 12 has an overall cylindrical cross-section with respect to a cross-section plane perpendicular to said spinning direction X-X. It is also possible to use a spinning chamber with a truncated cone cross-section which tapers towards the fibre feed device 16 and widening or flaring toward the spinning spindle 20.

According to one embodiment, the spinning spindle 20 has an overall cylindrical cross-section with respect to a cross-section plane perpendicular to said spinning direction X-X.

It is also possible to use a spinning spindle 20 having a truncated cone cross-section which tapers towards the fibre feed device 16.

The fibre feed device 16 may also comprise a needle 56 at least partially co-penetrated in said spinning chamber 12, so as to create a guide for the fibres being spun. The presence of said needle 56 is however optional.

As may be appreciated from the description, the air-jet type spinning device according to the invention makes it possible to overcome the drawbacks of the prior art.

In particular, the present invention allows a significant reduction of air consumption compared to the solutions of the prior art, in the configurations where the number of air injection channels (usually 1 per thread) is less than the conventional number (usually 4).

In addition, the present invention allows an increase in the size of the spinning chamber and a consequent greater ability to "digest" dirt and fibrils in the spinning process; this way a better yarn quality and greater consistency and repeatability of the characteristics of the yarn obtained is ensured.

In addition, there is a greater control of the path of the air injected inside the spinning chamber: even in the presence of obstacles (tangled fibres, cotton balls, dirt, etc.) the channel of the outer side wall of the spinning chamber always guides the air the same way. In this case too, a greater regularity of the resulting yarn is ensured.

Moreover, for the same overall size, an additional space is made on the outer side wall of the spinning chamber, thus increasing the overall size of the spinning chamber. This way the fibres are given more space to "open up" during the spinning process; as a result "longer" windings than with the solutions of the prior art can be obtained.

In addition, the solution of the present invention, unlike the solutions of the prior art, allows precise control of the path of the compressed air inside the spinning chamber. In fact, as seen, the outer side wall of the spinning chamber may have two suitably sized spirals (pitch and diameter), out of phase by 180° and inclined at a suitable angle which guide the path of the air injected into them from the nozzles. In fact the air, entering tangentially to the channel of the spiral, using the Coandă effect remains adherent to said spiral, thus generating a whirling motion and a given vacuum, in a controlled manner.

Unlike the solutions of the prior art, it is also possible to enter with the compressed air above the point of entry of the fibres in the spinning chamber, since the airflow does not directly "disturb" the incoming fibres. This is a further advantage, since it prevents interference between the fibres and the air, and thus makes the spinning process more controllable, so as to obtain a yarn with features as constant and repeatable as possible.

A person skilled in the art may make numerous modifications and variations to the air-jet type spinning devices described above so as to satisfy contingent and specific requirements while remaining within the sphere of protection of the invention as defined by the following claims.

The invention claimed is:

1. Air-jet type spinning device (4) comprising:

a body (8) including a hollow portion which delimits a spinning chamber (12), a fibre feeding device (16), facing said spinning chamber (12) so as to feed the fibres into the spinning chamber (12), a spinning spindle (20) wherein a portion is inserted in the spinning chamber (12) and fitted with a spinning channel (24) defining a spinning direction (X-X), a portion of the spinning chamber (12) is delimited by an outer side wall (32), opposite the spinning spindle (20), wherein the outer side wall (32) of the spinning chamber (12) comprises two spiral threads (36', 36") coaxial and staggered with each other by 180°, and wherein the spinning device (4) comprises at least two channels (28', 28"), each sending a jet of compressed air in one of the two spiral threads (36', 36"), wherein at least one channel (28) of the at least two channels (28', 28") is oriented so as to direct the jet of compressed air towards at least one thread (36) of the two spiral threads (36', 36") in order to be guided and oriented by the latter.

2. Air-jet type spinning device (4) according to claim 1, wherein said at least one thread (36) is a spiral thread, coaxial with said spinning channel (24) and parallel to the spinning direction (X-X).

3. Air-jet type spinning device (4) according to claim 1, wherein the outer side wall (32) of the spinning chamber (12) comprises a plurality of spiral threads (36), and wherein the spinning device (4) comprises at least one channel (28) which sends a jet of compressed air in each corresponding spiral thread (36).

4. Air-jet type spinning device (4) according to claim 1, comprising at least two channels (28) which send compressed air into respective distinct threads (36) which are staggered with each other with respect to the spinning direction (X-X).

5. Air-jet type spinning device (4) according to claim 1, wherein the spinning device (4) comprises at least two channels (28).

6. Air-jet type spinning device (4) according to claim 5, wherein the channels (28) are oriented in a direction tangential (T), with respect to an emission point (40), to the respective spiral threads (36).

7. Air-jet type spinning device (4) according to claim 1, wherein at least one channel (28) is oriented parallel to a horizontal plane (O-O) perpendicular to said spinning direction (X-X).

8. Air-jet type spinning device (4) according to claim 5, wherein the channels (28) are positioned so as to send the relative jets of compressed air to emission points (20) located upstream of a feed hole (44) of the fibres to the spinning chamber (12), relative to the spinning direction (X-X).

9. Air-jet type spinning device (4) according to claim 1, wherein said threads (36) have curved or semi-circular geometry cross-section.

10. Air-jet type spinning device (4) according to claim 9, wherein said threads (36) have curved or semi-circular geometry cross-section with a radius between 0.25 mm and 2 mm.

11. Air-jet type spinning device (4) according to claim 1, wherein said threads (36) are tilted at a helix angle of between 5° and 15°.

12. Air-jet type spinning device (4) according to claim 1, wherein the pitch of said threads (36) is between 1.5 mm and 4 mm.

13. Air-jet type spinning device (4) according to claim 1, wherein said threads (36) are threads with a varying pitch and/or varying helix angle.

14. Air-jet type spinning device (4) according to claim 1, wherein the spinning chamber (12) has overall a cylindrical cross-section with respect to a cross-section plane perpendicular to said spinning direction (X-X).

15. Air-jet type spinning device (4) according to claim 1, wherein the spinning spindle (20) has overall a cylindrical cross-section with respect to a cross-section plane perpendicular to said spinning direction (X-X).

16. Air-jet type spinning device (4) according to claim 1, wherein the fibre feeding device (16) comprises a needle (56), wherein a portion of the needle is penetrated in said spinning chamber (12).

17. Air-jet type spinning device (4) comprising:

a body (8) including a hollow portion that delimits a spinning chamber (12), a fibre feeding device (16), facing said spinning chamber (12) so as to feed the fibres into the spinning chamber (12), a spinning spindle (20) with a portion inserted in the spinning chamber (12) and fitted with a spinning channel (24) for the transit of yarn obtained from said fibres, the spinning channel (24) defining a spinning direction (X-X), at least one channel (28) for sending a jet of compressed air inside the spinning chamber (12) characterised in that a portion of the spinning chamber (12) is delimited by an outer side wall (32), opposite the spinning spindle (20), wherein the outer side wall (32) of the spinning chamber (12) comprises two spiral threads (36', 36") coaxial and staggered with each other by 180°, and wherein the spinning device (4) comprises at least two channels (28', 28"), each sending a jet of compressed air in one of said spiral threads (36', 36"), wherein said at least one channel (28) is oriented so as to direct the jet of compressed air towards the at least one thread (36).

18. Air-jet type spinning device (4) according to claim 17, wherein at least one thread (36) is made on said outer side wall (32).

19. Air-jet type spinning device (4) according to claim 17, wherein said at least one thread (36) is a spiral thread, coaxial with said spinning channel (24) and parallel to the spinning direction (X-X).

* * * * *